US009139035B2

(12) United States Patent
Braun et al.

(10) Patent No.: US 9,139,035 B2
(45) Date of Patent: Sep. 22, 2015

(54) PRODUCTION METHOD FOR A BOOKLET, AND A BOOKLET

(71) Applicant: Schreiner Group GmbH & Co. KG, Oberschleissheim, DE (US)

(72) Inventors: Uwe Braun, Munich (DE); Manfred Mueller, Egling-Schalkofen (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 268 days.

(21) Appl. No.: 13/710,673

(22) Filed: Dec. 11, 2012

(65) Prior Publication Data

US 2013/0147177 A1 Jun. 13, 2013

(30) Foreign Application Priority Data

Dec. 12, 2011 (DE) ..... 10 2011 056 289

(51) Int. Cl.

*B42D 1/00* (2006.01)
*B42D 7/00* (2006.01)
*B42C 9/00* (2006.01)
(Continued)

(52) U.S. Cl.

CPC ... *B42C 3/00* (2013.01); *B42D 1/00* (2013.01); *B42D 5/00* (2013.01); *B42D 13/00* (2013.01); *G09F 3/0288* (2013.01); *B42C 5/02* (2013.01); *B42C 7/00* (2013.01); *B42C 11/02* (2013.01); *B42C 11/04* (2013.01); *B42D 1/001* (2013.01); *B42D 1/002* (2013.01); *B42D 1/003* (2013.01); *B42D 1/006* (2013.01); *B42D 1/007* (2013.01); *B42D 1/008* (2013.01); *B42D 3/006* (2013.01); *B42F 21/12* (2013.01); *Y10T 156/108* (2015.01); *Y10T 156/1049* (2015.01); *Y10T 156/1051* (2015.01); *Y10T 156/1056* (2015.01); *Y10T 156/1057* (2015.01); *Y10T 156/1075* (2015.01); *Y10T 156/13* (2015.01); *Y10T 156/1304* (2015.01)

(58) Field of Classification Search

CPC ..... B42C 9/00; B42C 9/0006; B42C 9/0056; B42C 3/00; B42C 5/00; B42C 5/02; B42C 11/02; B42C 11/04; B42C 7/00; B42D 1/00; B42D 1/002; B42D 1/003; B42D 1/006; B42D 1/007; B42D 1/008; Y10T 156/1304; Y10T 156/13; Y10T 156/1051; Y10T 156/1049; Y10T 156/108; Y10T 156/1056; Y10T 156/1057; Y10T 156/1075

See application file for complete search history.

(56) References Cited

U.S. PATENT DOCUMENTS

| | | | | |
|---|---|---|---|---|
| 4,200,945 | A * | 5/1980 | Ellis | 412/4 |
| 5,234,735 | A | 8/1993 | Baker et al. | 428/40.1 |

(Continued)

FOREIGN PATENT DOCUMENTS

| | | | | |
|---|---|---|---|---|
| DE | 3811133 | A1 * | 9/1989 | B42D 1/04 |
| DE | 100 14 360 | | 10/2001 | B26D 7/0675 |
| DE | 10 2005 025 729 | | 12/2006 | B42D 5/003 |
| DE | 10 2008 020 831 | | 10/2009 | G09F 2003/0252 |
| EP | 0 754 566 | | 1/1997 | B42C 11/02 |

(Continued)

*Primary Examiner* — Linda L Gray
(74) *Attorney, Agent, or Firm* — Collard & Roe, P.C.

(57) ABSTRACT

In a production method for a booklet having an over-size cover sheet, first all the pages of the booklet are joined together and connected. Thereupon the cover sheet is at first folded aside and the remaining sheets are cut to the desired format. Subsequently, the cover sheet is brought to the desired over-size format in a special method, preferably using a laser beam. A booklet in which the cover sheet is cut in different manner than the remaining stack of sheets is produced according to the production process indicated above.

15 Claims, 3 Drawing Sheets

(51) Int. Cl.

| | |
|---|---|
| ***B42C 3/00*** | (2006.01) |
| ***B42C 5/00*** | (2006.01) |
| ***B42C 11/02*** | (2006.01) |
| ***B42C 11/04*** | (2006.01) |
| ***G09F 3/00*** | (2006.01) |
| ***B42D 5/00*** | (2006.01) |
| ***B42D 13/00*** | (2006.01) |
| *B42C 7/00* | (2006.01) |
| *B42C 5/02* | (2006.01) |
| *B42D 3/00* | (2006.01) |
| *B42F 21/12* | (2006.01) |

(56) References Cited

U.S. PATENT DOCUMENTS

| | | | | |
|---|---|---|---|---|
| 5,804,271 | A | 9/1998 | Barry | 428/40.1 |
| 6,057,019 | A | 5/2000 | Barry | 428/40.1 |
| 2004/0187660 | A1 | 9/2004 | Kurtz | 83/13 |
| 2006/0204700 | A1 | 9/2006 | Kiraly | 428/40.1 |
| 2007/0006698 | A1 | 1/2007 | Kurtz | 83/13 |

FOREIGN PATENT DOCUMENTS

| | | | | |
|---|---|---|---|---|
| EP | 0754566 | A1 * | 1/1997 | B42C 11/02 |
| EP | 1 053 890 | | 11/2000 | B42C 11/02 |
| EP | 1 745 941 | | 1/2007 | B26D 1/09 |

* cited by examiner

PRODUCTION METHOD FOR A BOOKLET, AND A BOOKLET

CROSS REFERENCE TO RELATED APPLICATIONS

Applicant claims priority under 35 U.S.C. §119 of German Application No. 10 2011 056 289.3 filed Dec. 12, 2011, the disclosure of which is incorporated by reference.

BACKGROUND OF THE INVENTION

1. Field of the Invention

The present invention relates to a booklet having an over-size cover sheet as well as to a production method for such a booklet having an over-size cover sheet.

2. The Prior Art

Booklets, i.e. small booklets having a few sheets, represent a way to provide a limited amount of information to a user in printed form. Such a booklet generally comprises a few pages, up to several tens of pages.

Usually, the pages are sheets of paper, which are usually printed on both sides. The individual sheets are joined together after printing and bound on one side. In the simplest case, the binding can involve joining by means of simple staples. For more high-quality booklets, however, a folded and glued binding or a glued binding is preferred.

Subsequently, the sheets of the booklet are cut to the desired format, together, at their outer edges. Because of the limited number of pages and the resulting relatively slight material thickness of the entire booklet, it is possible to use known cutting or punching methods here.

Such a booklet can be enclosed with a product, for example, as a small information brochure or operating instructions. In special application cases, it is advantageous, in this connection, if the booklet is attached to the related product. For example, such a booklet can be glued onto the product by means of an adhesive.

In connection with the gluing of a booklet onto a product as described above, however, the possibility exists that the individual pages of the booklet will project away from the product. A poor appearance would therefore result. Furthermore, there is also the risk, if individual pages project out, that the booklet could quickly be damaged or could be torn off the product.

In order to counteract projecting of individual booklet pages, there are various efforts to also glue the uppermost page of the booklet, in other words the cover sheet, to the corresponding product. For this purpose, however, it is necessary that the cover sheet of the booklet projects beyond the other pages, at least at one location. Only in this way can the projecting region be glued directly to the product, in order to prevent projecting of the booklet pages.

If all the pages of the booklet are cut to a common size during production, as described above, however, the cover sheet at first possesses no region that would allow gluing of the cover sheet to the product. For this reason, it is necessary to subsequently enlarge the cover sheet once again, at the desired location, via additional method steps.

For example, an additional layer of material can be applied to the cover sheet, which is larger in dimensions at the desired location than the pages of the booklet that lie underneath. In this connection, however, the cover sheet would consist of at least two different material layers, and thus have a significantly greater thickness. Furthermore, the laminate to be applied to the booklet would have to be applied very precisely, and this requirement entails correspondingly great production effort.

Alternatively, it would also be possible to first cut all the sheets of the booklet to the desired format individually, and to select a larger dimension for the cover sheet, in this connection, right from the start. Only after all the sheets have been cut to size are they joined together using a suitable binding method. This procedure, however, requires very precise joining and binding of the individual sheets, with a corresponding greater process effort. Nevertheless, it generally cannot be guaranteed that the user can perceive certain tolerances of the individually joined pages.

SUMMARY OF THE INVENTION

It is therefore an object of the present invention to provide an alternative, easy to implement production method for a booklet having an over-size cover sheet.

These and other objects are accomplished according to the invention by a production method for the production of a booklet having a cover sheet, which comprises the following steps: Providing a booklet having a cover sheet and at least one further sheet; lifting the cover sheet up from the at least one further sheet; then cutting the at least one further sheet; then folding the cover sheet back down; and then cutting the cover sheet, so that its outer contour projects beyond the at least one further sheet.

Furthermore, the object of the invention is accomplished by a booklet having an over-size cover sheet and a plurality of further sheets, which is produced using the production process mentioned above.

It is a particular approach of the present invention to first join together all the pages of a booklet and to connect them with one another by means of a suitable method, and only subsequently to cut the cover sheet and the remaining pages to different sizes. For this purpose, the cover sheet is first folded away from the remaining pages. Subsequently, all the pages with the exception of the cover sheet are cut to a common length. In a separate step, the cover sheet is then separately cut to the desired shape.

By positioning the cover sheet upright, an over-size cover sheet can be achieved in surprisingly simple and efficient manner, despite previously binding together all the pages. This cover sheet is advantageous for the desired booklets and for their use and further processing.

Preferably, the cover sheet is cut in such a manner that the outer contour of the cover sheet is larger, at least in part, than the outer contour of the at least one further sheet or the plurality of further sheets after cutting. The cover sheet thus projects beyond the sheet or sheets that lie underneath. In this way, the sheets of the booklet that lie underneath the cover sheet are protected, on the one hand, and on the other hand, the projection of the cover sheet serves as a grip tab for opening the booklet.

In a preferred embodiment of the production method, in the step for positioning the cover sheet upright, the cover sheet is positioned upright at an angle of about 90 degrees. With a cover sheet positioned upright in this manner, the other pages of the booklet can be cut without problems and without the cover sheet itself being damaged in this connection.

In a special embodiment, cutting of the outer contour of the cover sheet takes place using a laser beam. Cutting with a laser beam, also called "laser punching," is a suitable method for cutting the cover sheet with almost any desired outer contour. Thus, the greatest possible flexibility with regard to shaping of the cover sheet is achieved.

Preferably, in the step for providing the booklet, a booklet blank having a plurality of booklets disposed next to one another and attached to one another is provided. Thus, multiple booklets can be produced at the same time in a single process cycle. Alternatively, in the step for providing the booklet, only a single booklet can be provided.

In a preferred embodiment, in the step for providing the booklet, a stack having a plurality of sheets stacked one on top of the other is provided. Particularly preferably, this embodiment also comprises a step for binding the stack of sheets.

Particularly preferably, binding of the stack of sheets takes place by means of a glued binding or a folded and glued binding. These binding methods have proven to be particularly suitable, specifically for booklets.

Preferably, the method also comprises a step for applying an upper laminate to the cover sheet. The booklet that lies underneath, according to the invention, is reliably protected by such an upper laminate. Particularly preferably, the upper laminate includes an adhesive coating on the side facing the cover sheet. In this way, the entire structure can conveniently be applied to an object to be identified.

In a special embodiment, the production method furthermore comprises a step for applying a lower laminate, whereby the lower laminate is applied on the side of the booklet that faces away from the upper laminate. Thus, the booklet is protected on both sides, by an upper and a lower laminate, in each instance.

A particular embodiment of the production method comprises a step for introducing a weakening line in the upper laminate. Thus, part of the upper laminate can easily be removed and used further, separately, as an ancillary or documentation label.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention. In this connection, the drawings are schematic representations. The size relationships in the drawings do not necessarily agree with practical reality, but rather are greatly exaggerated, in part, for a better representation.

In the drawings, wherein similar reference characters denote similar elements throughout the several views.

DETAILED DESCRIPTION OF THE PREFERRED EMBODIMENTS

Figure 1:
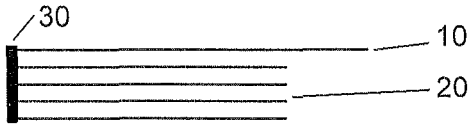
FIG. 1 shows a section through a booklet that was produced according to the production method according to the invention.

Referring now in detail to the drawings, FIG. 1 shows a cross-section through a booklet structure that was created using a production method according to the invention. The booklet comprises multiple individual sheets 20. The individual sheets of the booklet can be one or more printed paper sheets that were previously folded using a corresponding, suitable method, in such a manner that a booklet having multiple pages is obtained. Four individual sheets 20 as well as a cover sheet 10 are shown in FIG. 1. In general, the number of sheets can be less or more, for example up to 20 individual sheets plus the cover sheet.

These individual sheets are connected with one another on the left side in FIG. 1, in the region of the binding 30, by means of a suitable method. The binding 30 can be structured as a glued binding, for example, or can be produced using the folding and gluing method.

The particular feature of the booklet in FIG. 1 now consists in that the cover sheet 10 projects beyond the pages 20 that lie underneath it, at least in part, on one side. In the example shown, this arrangement is the case on the side shown on the right, in that the cover sheet 10 projects to the right beyond the edge of the sheets 20, shown on the right.

In the following, the method according to the invention, for production of a booklet, will be described making reference to the figures FIG. 2*a* to FIG. 2*f*.

Figure 2A:
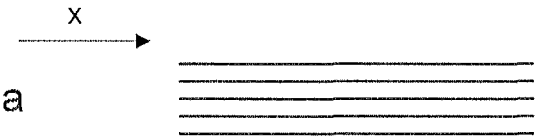
FIGS. 2*a* to 2*f* are schematic representations of the method steps of the production method according to the invention.

As shown in FIG. 2*a*, first a stack of multiple sheets of the booklet is provided. As has already been described above, this stack can involve one or more paper sheets, for example, printed on one or preferably on both sides. The sheets are folded in suitable manner so that the individual pages come to lie one on top of the other in the correct sequence. Of course, alternatively it is also possible to lay multiple individual sheets one on top of the other and to arrive at a booklet having multiple pages in this manner.

Figure 2B:
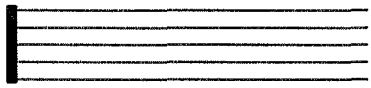

In the next step, as shown in FIG. 2*b*, the sheets are firmly connected with one another on one side. This connection is generally done by means of a suitable binding method, which is known from the sector of bookbinding. For example, the binding can be structured as a glued binding, or can be produced using a folding and gluing method. Other binding methods that lead to the desired result are also possible. For the further explanations, a direction x is introduced, which runs away from the binding in the direction toward the edge of the cover sheet 10 or the further sheets 20 that lies opposite, shown on the right.

Figure 2C:
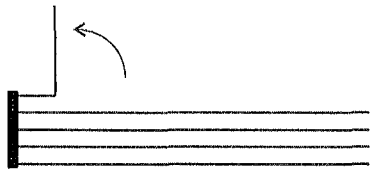

In the step shown in FIG. 2*c*, the cover sheet 10 is then first positioned upright, toward the top, so that it stands upright approximately at a right angle. In other words cover sheet 10 stands about in a 90 degree angle. Fundamentally, in this connection, other angles are also possible. For example, the cover sheet could also be folded away to the back by almost 180°, or by less than 90°, for example by up to 45°. In particular, the cover sheet is positioned upright or lifted up at an angle of 85° to 95° relative to the further sheets 20. It is essential in this step, however, that cutting off of the pages that lie underneath, which follows in the next step, is not hindered by the cover sheet.

Figure 2D:
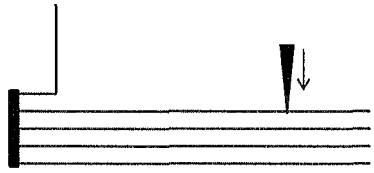

After the cover sheet has been folded away upward as shown in FIG. 2*c*, subsequently, as shown in FIG. 2*d*, the sheets 20 that lie underneath are cut to the desired length, in the direction x, in a common work step. Usually, this step takes place by means of a sharp blade, a type of guillotine, or also a suitable punching device.

Fundamentally, this result could also be achieved in that the cover sheet 10 is only slightly lifted off the further sheets 20, so that a solid plate, for example a metal plate, is pushed between cover sheet 10 and the further sheet 20 that lies closest to the cover sheet 10. In this way, the result is achieved that the cover sheet 10 is not influenced by the cutting process that is used for the further sheets 20, and, vice versa, that the cutting process at the further sheets 20 is not hindered by the cover sheet 10 if the cutting or punching tool is brought up to the booklet from below, in other words the further sheet 20 that lies farthest away from the cover sheet is contacted first by the cutting or punching tool.

Figure 2E:
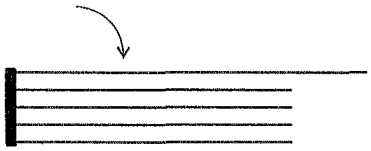

Subsequently, the cover sheet 10 can be folded back into its original starting position, parallel to the other sheets 20, as shown in FIG. 2*e*.

Figure 2F:
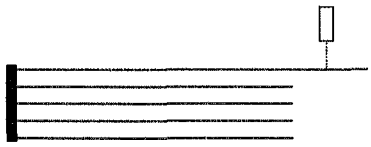

In a further step, the outer edge of the cover sheet 10 corresponding to the representation in FIG. 2*f*, is subsequently cut to the desired length in the direction x and the desired shape, in accordance with the step shown in FIG. 2*e*. For this purpose, cutting using a laser beam, for example, is particularly suitable. Such a laser beam can be guided in almost any desired manner, by means of software, and therefore can cut out even very individually complex contour shapes in very precise manner. In this step, however, it is very important that the contour to be cut out by the laser beam is situated outside of the sheets 20 that lie underneath. Otherwise, the risk exists that the sheets 20 that lie underneath would be damaged, at least in part, by the energy of the laser beam. With regard to the shape, it can be provided that a grip tab is formed, as described further below, for example grip tab 12 as shown and described in FIG. 6*b*.

After completion of this step, one at first obtains a booklet in which all the sheets were cut to the desired length, in the position shown, both on the left and on the right.

In a further step, the remaining two edges can also be cut to the corresponding length in conventional manner, by means of a blade, a punch, or in similar manner.

Figure 3:
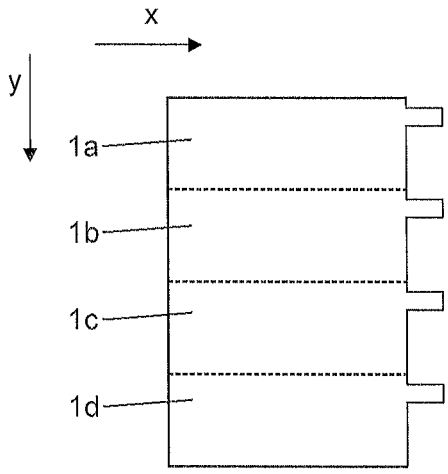
FIG. 3 is a schematic representation of a booklet blank having multiple panels.

Fundamentally, it is possible to cut each individual booklet separately, in the manner described, and to produce individual booklets, in each instance, in this manner. In order to allow a particularly efficient production process, however, stacks of paper can also be produced and provided first, in which a plurality of booklets 1*a* to 1*d* are disposed next to one another, as shown in FIG. 3, for example.

In the figure shown, for example, four booklets are disposed next to one another; however, any other number of booklets that lie next to one another is possible. In other words, printed sheets are produced, on which all the contents for these four booklets are jointly present. A common paper stack is first produced for the step from FIG. 2*a*, and this stack is then processed as described above during the further sequence of events. Such a paper stack that comprises multiple individual booklets is usually referred to as a booklet blank. In this example, the booklet blank has a dimension of four booklets cohesively disposed next to one another. Two books directly adjacent to one another, in each instance, are connected with one another and have a common, imaginary edge that runs in the direction x, along which the booklets are later cut and separated. The adjacent booklets are disposed next to one another in a direction y, perpendicular to the direction x. Each individual booklet contains the same printed information, for example, and the dimensions of each individual booklet of the booklet blank are the same.

After such a booklet blank has been produced with an over-size cover sheet, analogous to the production method described above, the individual booklets can then be cut out and separated from one another or singularized, using a suitable cutting or punching method, after the left outer contour of the common cover sheet of the booklet blank has been cut. Thus, a plurality of individual booklets is obtained in very efficient manner, in a single process cycle.

Figure 4:
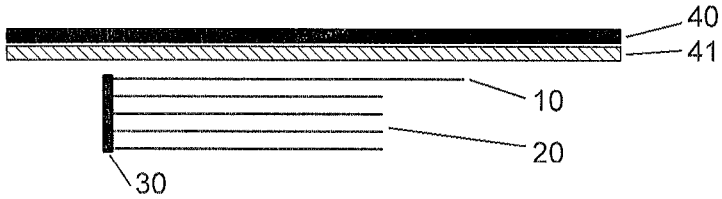
FIG. 4 is a schematic cross-sectional view through a special embodiment of a booklet.

Independent of whether a booklet was now produced directly as an individual booklet or whether the booklet was produced by way of a booklet blank having multiple panels, such booklets having an over-size cover sheet are particularly well suited as a self-adhesive solution for application to a surface. As shown in FIG. 4, an upper laminate 40 with an adhesive 41 can be applied over the cover sheet for example; this laminate is applied to the cover sheet and projects beyond it, at least in part.

Such a booklet can be glued onto a surface or an object in particularly simple manner with the projecting regions of the self-adhesive upper laminate 40. In this connection, the over-size cover sheet of the booklet covers a part of the self-adhesive laminate, and thereby protects the open side of the booklet from being glued together.

Figure 5:
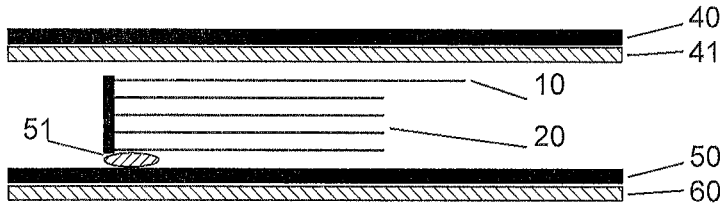
FIG. 5 is a schematic cross-sectional view through another special embodiment of a booklet.

FIG. 5 shows an alternative embodiment of a composite that comprises a booklet produced according to the invention, having an over-size cover sheet. In this connection, the booklet is first applied to a lower laminate 50. In this connection, the booklet is glued to the lower laminate 50. The booklet can be glued to the lower laminate 50 either over its full area, or, particularly preferably, only in a small region as shown in FIG. 5, by means of an adhesive 51.

For protection against damage and ambient influences, the booklet with the lower laminate 50 is provided with an upper laminate 40, as was already described above in the previous exemplary embodiment.

In order to be able to affix this structure composed of booklet, upper laminate 40, and lower laminate 50 to an object in the simplest possible manner, the lower laminate 50 is provided with an adhesive 60, on the side facing away from the booklet, in whole or in part. Pressure-sensitive adhesives are particularly well suited for this purpose.

Figure 6A:
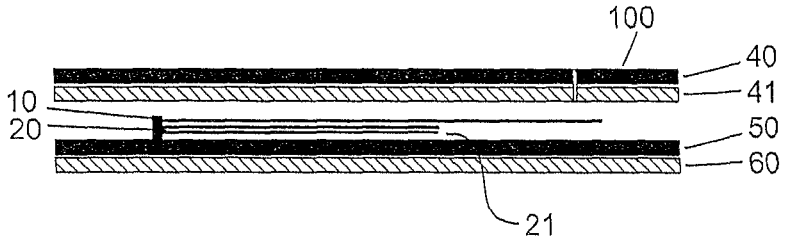
FIGS. 6*a* and 6*b* are schematic representations of another alternative embodiment, in cross-section and in a top view.
Figure 6B:
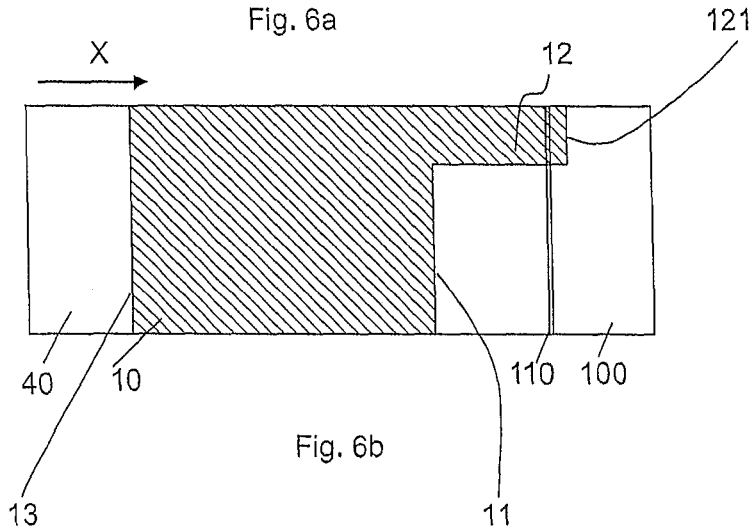

FIGS. 6*a* and 6*b* show another embodiment of a structure with a booklet produced according to the invention. In the previous example, this structure comprises booklet, lower laminate 50, and upper laminate 40. In contrast to the previous exemplary embodiment, this variant is supplemented, on the right side, with an additional region 100. On the underside, this region 100 consists of an extension of the lower laminate 50. On the top side, the upper laminate 40 is also lengthened accordingly, whereby the upper laminate 40 is punched along the edge 110, so that a weakening line is formed. An adhesive is situated between upper laminate 40 and lower laminate 50.

The over-size cover sheet 10 of the booklet produced according to the invention also projects partly into the additional region 100, so that upper laminate 40 and lower laminate 50 are glued to one another in this region, into which the over-size cover sheet 10 projects. The cover sheet 10 therefore projects beyond the weakening line 110. In this region, a user can therefore reach in very easily and thereby can grasp the upper laminate 40. Subsequently, the user can pull off the upper laminate 40 and glue it back down at a different location, because of the adhesive that is contained in it.

The upper laminate from the region 100, pulled off in this manner, serves, in this case, as a kind of documentation label that can be produced together with the booklet and applied to an object. At a later point in time, this documentation label can then be affixed elsewhere, for example for documentation purposes.

The edge 11 of the cover sheet 10 of the booklet shown on the right is cut in such a manner that it projects to the right beyond the edge 21 of the further sheets 20 and the weakening line 110. In this case, the distance between the left and the right edge 13 and 11, respectively, of the cover sheet 10 is greater than the comparable distance between the left and right edge 13 and 21, respectively, of the further sheets 20. The right edge 11 of the cover sheet 10 projects beyond the right edge 21 of the further sheets by a specific length. This length can be dependent on the use of the booklet. In practice, this length is at least 1 mm (millimeters), preferably about 2-4 mm. The length can be even longer, for example if the booklet is to be applied to a round body.

Furthermore, in FIG. 6*b*, the grip tab 12 of the cover sheet 10 is shown, which is extended beyond the right edge 11 of the cover sheet 10 in the direction x. The grip tab comprises only a section of the right edge of the cover sheet 10 and is situated at the upper longitudinal edge of the cover sheet 10. The left edge 121 of the grip tab lies within the surface area of the region 100 and can be gripped with the fingers of a person once the region 100 has been removed. To state it differently, the weakening line 110 runs over the grip tab 12, while the weakening line does not run over the cover sheet 10 in the region outside the grip tab.

In summary, the present invention relates to a production method for a booklet having an over-size cover sheet. For this purpose, first all the pages of the booklet are joined together and connected. Thereupon the cover sheet is at first folded aside and the remaining sheets are cut to the desired format. Subsequently, the cover sheet is brought to the desired over-size format in a special method, preferably by means of a laser beam. The invention furthermore comprises a booklet in which the cover sheet is cut in different manner than the remaining stack of sheets, according to the production process indicated above.

Although only a few embodiments of the present invention have been shown and described, it is to be understood that many changes and modifications may be made thereunto without departing from the spirit and scope of the invention as defined in the appended claims.

What is claimed is:

1. A method for producing a booklet having a cover sheet, comprising the steps:

providing a booklet having a cover sheet and at least one further sheet;

lifting the cover sheet up from the at least one further sheet;

then cutting the at least one further sheet using a blade or a punching device;

then placing the cover sheet back down on top of the at least one further sheet; and then cutting the cover sheet using a laser beam so that an outer contour of the cover sheet projects beyond the at least one further sheet.

2. The method according to claim 1, wherein the cover sheet is cut in such a manner that the outer contour of the cover sheet is at least partly larger than an outer contour of the at least one further sheet after cutting.

3. The method according to claim 1, wherein the cover sheet is positioned upright at an angle of about 90 degrees in the step of lifting up the cover sheet.

4. The method according to claim 1, wherein the cutting of the outer contour of the cover sheet takes place using the laser beam.

5. The method according to claim 1, wherein in the step of providing the booklet, a booklet blank having a plurality of booklets disposed cohesively next to one another is provided, and the booklets are separated from one another after cutting of the cover sheet.

6. The method according to claim 1, wherein a single booklet is made available in the step of making the booklet available.

7. The method according to claim 1, wherein a stack having a plurality of sheets disposed one on top of another is made available in the step of making the booklet available.

8. The method according to claim 7, which furthermore comprises a step of binding the stack of sheets before the step of lifting up the cover sheet.

9. The method according to claim 8, wherein the step of binding the stack of sheets comprises forming a glued binding or a folded and glued binding.

10. The method according to claim 1, which furthermore comprises a step of applying an upper laminate to the cover sheet.

11. The method according to claim 10, wherein the upper laminate comprises an adhesive coating on a side of the upper laminate that faces the cover sheet.

12. The method according to claim 10, which furthermore comprises a step of applying a lower laminate, wherein the lower laminate is applied on a side of the booklet that faces away from the upper laminate.

13. The method according to claim 10, which furthermore comprises a step of introducing of a weakening line into the upper laminate.

14. The method according to claim 13, in which the cover sheet comprises a grip tab and the weakening line covers the grip tab and does not cover the cover sheet outside of the grip tab.

15. A booklet having an over-size cover sheet and a plurality of further sheets, produced by a production process comprising the steps of making providing a booklet having a cover sheet and at least one further sheet; lifting the cover sheet up from the at least one further sheet; then cutting the at least one further sheet using a blade or a punching device; then placing the cover sheet back down on top of the at least one further sheet; and then cutting the cover sheet using a laser beam so that an outer contour of the cover sheet projects beyond the at least one further sheet.

* * * * *

UNITED STATES PATENT AND TRADEMARK OFFICE

CERTIFICATE OF CORRECTION

PATENT NO. : 9,139,035 B2
APPLICATION NO. : 13/710673
DATED : September 22, 2015
INVENTOR(S) : Braun et al.

It is certified that error appears in the above-identified patent and that said Letters Patent is hereby corrected as shown below:

In the Claims

In particular, in Column 8, line 42 (Line 3 of Claim 15) after "of", please delete: "making".

Signed and Sealed this
Ninth Day of February, 2016

Michelle K. Lee

Michelle K. Lee
*Director of the United States Patent and Trademark Office*